United States Patent [19]

Jamieson

[11] Patent Number: 4,646,670

[45] Date of Patent: Mar. 3, 1987

[54] SAIL SYSTEM FOR SAILBOARDS, AND BOARDSAILING APPARATUS AND METHOD

[76] Inventor: Robert S. Jamieson, 667 S. Hudson Ave., Pasadena, Calif. 91106

[21] Appl. No.: 574,004

[22] PCT Filed: Apr. 21, 1983

[86] PCT No.: PCT/US83/00616

§ 371 Date: Dec. 23, 1983

§ 102(e) Date: Dec. 23, 1983

[87] PCT Pub. No.: WO83/03805

PCT Pub. Date: Nov. 10, 1983

Related U.S. Application Data

[63] Continuation-in-part of Ser. No. 371,226, Apr. 23, 1982, abandoned, which is a continuation-in-part of Ser. No. 304,113, Sep. 23, 1981, Pat. No. 4,365,570, which is a continuation-in-part of Ser. No. 289,386, Aug. 3, 1981, abandoned.

[51] Int. Cl.[4] ..... B63H 9/08

[52] U.S. Cl. ..... 114/102; 114/98; 114/39; 16/115; 74/546

[58] Field of Search ..... 114/39.1, 39.2, 89, 114/97, 98, 102, 103, 108, 109, 110, 111, 112, 113, 114, 115; 16/115, DIG. 39; 74/544, 545, 546

[56] References Cited

U.S. PATENT DOCUMENTS

| | | | |
|---|---|---|---|
| 337,488 | 3/1886 | Evers | 16/115 |
| 3,285,215 | 11/1966 | Potter | 114/102 |
| 3,626,886 | 12/1971 | Cafiero | 114/103 |
| 4,044,702 | 8/1977 | Jamieson | 114/109 |
| 4,253,209 | 3/1981 | Carn | 114/39.2 |
| 4,448,142 | 5/1984 | Pollard | 114/99 |

FOREIGN PATENT DOCUMENTS

| | | | |
|---|---|---|---|
| 2233006 | 1/1974 | Fed. Rep. of Germany | 114/102 |
| 7421380 | 12/1974 | Fed. Rep. of Germany | 114/39.2 |
| 2912671 | 7/1980 | Fed. Rep. of Germany | 114/97 |
| 2941134 | 4/1981 | Fed. Rep. of Germany | 114/97 |
| 3032631 | 4/1982 | Fed. Rep. of Germany | 114/39.2 |
| 2252950 | 8/1975 | France | 114/97 |
| 63595 | 4/1983 | Japan | 114/392 |
| 620645 | 12/1980 | Switzerland | 114/109 |

*Primary Examiner*—Galen Barefoot
*Assistant Examiner*—Thomas J. Brahan

[57] ABSTRACT

An improved single-boom sailing rig for sailboards, and methods of use, are disclosed. A curved, rotatable boom (100) is provided with a forward end set at a slight angle with respect to the chord, with a separately-rotatable camber control (110) located in the forward end within reach of the sailor's forward hand, for controlling sail curvature with sails (18 and 19) filled and drawing. A finger-operated mast clamp (120) connects boom (100) to mast (13) and provides pivot pin (126) as a bearing onto which the boom (100) may be pushed during assembly. A boom extension (130) is provided with an eccentric locking mechanism for matching boom length to various sail sizes. An alternative extension (230) is locked by insertion of a pin (233) through any of a series of holes (234). Boom extensions (130 and 230) are provided with a sand-proof aft boom bearing assembly (140) having an aft pivot pin (141) which is pushed into plug (145) during assembly, to connect the clews of sail components (18 and 19). A resilient line (149) and a wingscrew (153) provide length and differential sail stretch matching adjustments for sail components (18 and 19), to prevent air leaks between flap (21) of upper sail component (18) and head (22) of lower sail component (19). Sand is excluded from entering camber control (110) and extension (130) by compression of heat-shrink tubes (119 and 139) against wiping rings (118 and 132). In a variation using low-stretch composite sail materials, or radially-cut sails, the wingscrew (153) is eliminated and clew plates (150 and 155) may be replaced by grommets.

The sailor matches the length of boom (100) to that of the sails of his choice by moving extension (130 or 230) in or out of boom end (103) and locking it in place. With the sail full and drawing, the sailor may change sail curvature by rotating camber control (110) with his forward hand.

38 Claims, 9 Drawing Figures

FIG. 1.
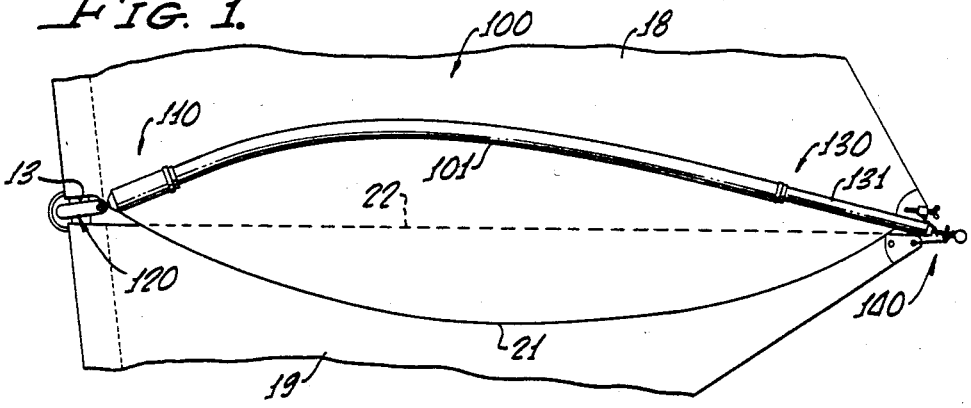
FIG. 2.
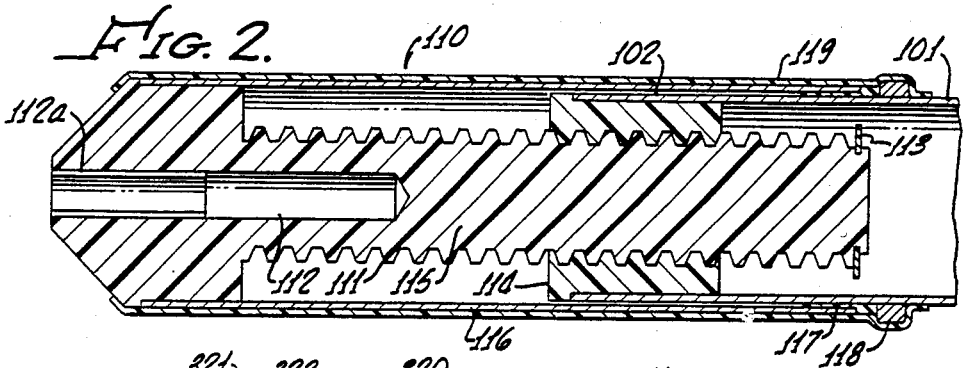
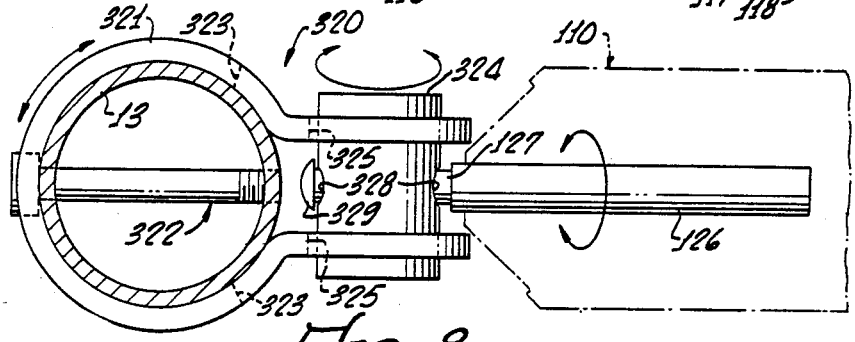
FIG. 8.
FIG. 5.
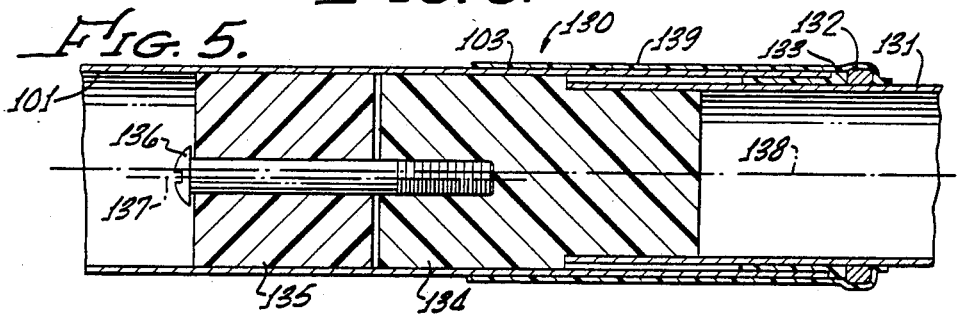

SAIL SYSTEM FOR SAILBOARDS, AND BOARDSAILING APPARATUS AND METHOD

CROSS-REFERENCE TO RELATED APPLICATIONS

The present application is a continuation-in-part of my U.S. patent application Ser. No. 06/371,226, filed Apr. 23, 1982 now abandoned. Said application is a continuation-in-part of U.S. application Ser. No. 304,113, filed Sept. 23, 1981, now U.S. Pat. No. 4,365,570. The latter patent application is a continuation-in-part of U.S. application Ser. No. 289,386, filed Aug. 3, 1981, now abandoned. The disclosures of these applications (and said issued patent) are incorporated by this reference as though set forth in full herein. U.S. Pat. No. 4,365,570 corresponds to PCT patent application Ser. No. PCT/US82/01039, which PCT application is also incorporated by reference herein.

TECHNICAL FIELD, AND BACKGROUND OF THE INVENTION

The apparatus and method disclosed in said U.S. Pat. No. 4,365,570 represent a major advance in the boardsailing art. ("Boardsailing", "sailboard", etc., comprehend, as employed in this specification and claims, all types of single-person sailing craft in which (a) the operator stands at all times, and (b) the thus-standing operator steers the craft by tilting the mast in various directions. The sailing may occur on water, on land, or on ice or snow. The "board" or other hull means on which the operator stands may float or may be wheeled, have runners or skis, etc.

There are, however, important problems and goals not solved or achieved by the prior art, which art includes (for example) German Utility Model No. 7421380, issued Dec. 12, 1974. (Such Utility Model shows a form of curved single boom that rotates about a generally horizontal axis.) The important problems include, among others, the following:

(a) Sand, whether it be typical "grit" or "grain" sand or the extremely fine coral sand present on many beaches. Boardsailers often drag portions of sailboard rigs across beaches, which can cause sand infiltration into the bearings. Such infiltration is, frequently, not obviated even after the rig is immersed in the water.

(b) Friction, especially when augmented by sand infiltration. The rotating boom must not seize or bind. Furthermore, and very importantly, the rotation of the boom must not twist or wrap the outer ends of the sail elements about the outer end of the boom.

(c) Outhauling of the sails. The upper and lower sails must have the proper outhauled relationship, relative to each other, in order to achieve the most effective lapped sealing relationship described in U.S. Pat. No. 4,365,570. Furthermore, it is extremely desirable that the operator be able to achieve a precise desired outhaul adjustment of both sails while he is actually sailing along, and even while leaning back in the balanced condition so characteristic of the sailboarding art, because such adjustment increases the efficiency and speed of sailing on various tacks and with variable wind speeds.

(d) Proper boom curvature, so that the boom will not appear awkward to the sailboarder, or even create pain in, or injury to, his wrist while he hangs on the boom hour after hour, and so that the boom may rotate between close-hauled sail components.

(e) High-strength connection of the boom to any desired point on the mast, without requirement for tools, and without interference with boom rotation or boom angle.

(f) Matching of boom length to sail length, to avoid a boom-sail relationship whereby the outer boom end sticks out an excessive distance past the sails.

(g) Good aesthetics, relatively low cost, and simplicity vis-a-vis the boom and its hardware. The achievement of these major goals is crucial, especially where a drastically novel sail rig must compete commercially with long-known booms (and hardware) of non-rotating construction.

(h) Small size. It is a distinct advantage if sails, boom, and hardware (everything except board and mast) can be shipped, stored, and stowed in a relatively small space.

The present invention solves all of the above problems and achieves all of the above goals. Particularly when employed in conjunction with the apparatus and method of said U.S. Pat. No. 4,365,570, there is attained an entire highly-advanced generation of sailboards and rigs therefor.

PRELIMINARY DISCLOSURE OF CERTAIN ASPECTS OF THE INVENTION

In accordance with one important aspect of the present invention, the boom is provided with an infinitely variable camber (sail curvature along the length of the boom) control located at the forward end of the boom. The forward end of the boom is where the sailor's forward hand grips the boom, to support his weight. (The sailor'aft hand is used not only to support his weight, but to act in controlling the angle between the sail and the wind, and hence has an additional task.) Applicant provides an internal jackscrew having an external tube which acts both as handgrip and as a handle for rotating the jackscrew and thereby changing the length of the boom. The sailor may thus adjust sail camber during either lulls or gusts, without having to let go the boom first or to spill wind from the sail. The jackscrew provides a mechanical advantage far in excess of that of a conventional rope tackle outhaul. Therefore, even a small or weak sailor may easily change camber in the strongest winds in which he can sail.

The boom has a small angle (and is straight) at the forward portion thereof, so that no discomfort will be felt in the sailor's wrist, and so that there will be no interference with the jackscrew.

In accordance with another important aspect of the present invention, the clews of the sail components are connected to a small diameter pivot pin, by links which are fitted loosely around the pivot pin, such that no large quantity of sand may accumulate therebetween, and such that any motion will dislodge any grains of sand accumulated, and such that the links will either push aside sand adhering to the pivot pin or be pushed aside themselves, and further wherein the pivot pin itself may rotate in its lodging. Thus, the rig may be dragged along the beach, in accord with standard practice, without danger of seizing or greatly increasing friction of the bearings thus provided, and of subsequent inhibiting of tacking or gybing. The bearing system has the further advantage that its size reduces, to insignificance, geometrically-caused discrepancies between the horizontal lengths of the two sail components induced by rotation of a curved boom.

In accordance with another major aspect of the present invention, the forward end of the boom is provided with a pivot pin whose trunnion-shaped head passes through loose, short bearing rings in the walls of a transverse trunnion bearing bore, in which sand cannot stay. Thus, neither bearing can accumulate a sufficient buildup of grains of sand to greatly increase friction or cause seizing of the bearings. In addition, the pivot pin is free to rotate in its lodging hole in the forward end of the boom. Such pivot-pin rotation, in combination with rotation of the mast about the mast axis, achieve major results relative to boom angle and camber control.

In accordance with a further major aspect, the boom is mounted on the mast by a hand-wheel mechanism not requiring any tools.

Relative to yet another important aspect, adjustment of the after clews, relative to each other, is achieved by an extremely simple, rugged, and bind-resistant means.

It is emphasized that any or all aspects of the present invention relating to the curved boom may be employed on a straight boom, the major functional difference between the two booms being in the bend of the curved boom, and the fact that the straight boom is not rotated in order to be put through the sail.

BRIEF DESCRIPTION OF THE DRAWINGS

FIG. 1 is a side elevational view of the intermediate portion of the rig, showing the boom in place and connected to the clews;

FIG. 2 is a fragmentary sectional view of the forward end of the boom, showing the sail camber control mechanism;

FIG. 5 is a fragmentary sectional view of the aft end of the boom, showing twist-lock eccentrics and the boom extension tube;

FIG. 8 shows a former form of the mast-connector and associated bearing.

DETAILED DESCRIPTION OF THE PREFERRED EMBODIMENT OF THE BOOM

Figure 3:
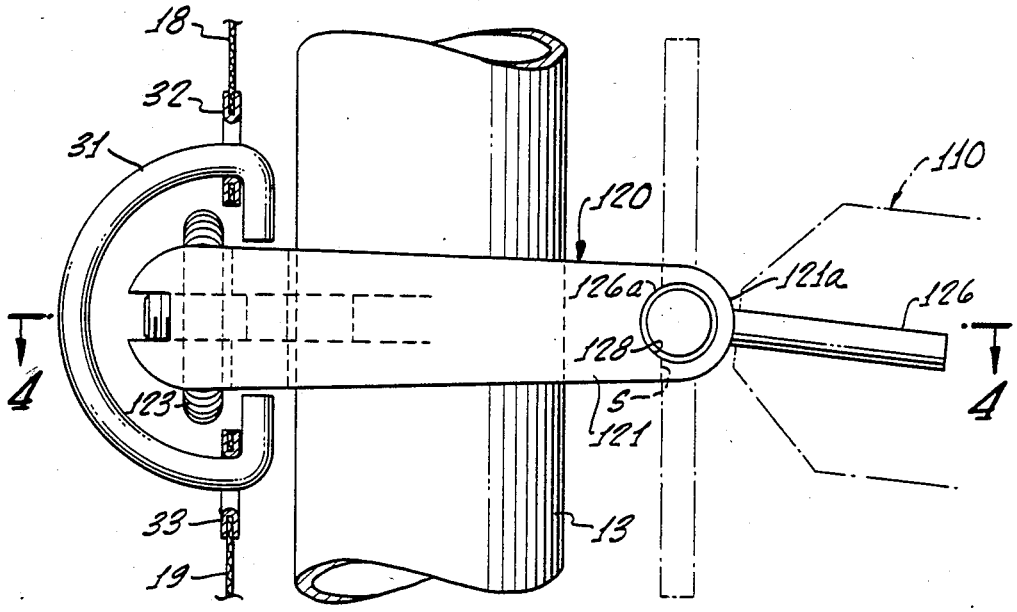
FIG. 3 is a side elevational view of the connection of the boom to the mast, showing the forward boom bearing assembly.

Referring to FIG. 1, a boom is shown in operating condition, mounted on a mast and connected to the two-component sail of U.S. Pat. No. 4,365,570. The mast is mounted on a sailboard (not shown) as disclosed in said U.S. Patent.

The sail is shown on the port tack, with flap 21 (bottom edge region of the upper sail component 18) to windward, or port, of head 22 (top edge region of the lower sail component 19). For clarity, the boom, indicated generally at 100, is shown rotated upward; in normal sailing conditions it would be horizontal, or below.

It is emphasized that the upper edge of the lower sail is lapped relative to the lower edge of the upper sail. Such edges are not connected to each other; thus, the curved boom may rotate between and through the lapped edges.

Boom 100 comprises a camber control assembly 110 mounted on the forward boom end, capable of changing the length of boom 100, and pivotally connected to a forward bearing assembly and mast connector 120. A (major) boom extension assembly 130 is inserted in the aft end of boom tube 101 and is connected to and supported pivotally by aft bearing and adjustment assembly 140.

As shown in FIG. 1, the central portion of boom tube 101 is preferably curved, with the end portions being straight so as to permit the movements of both camber control 110 and extension 130 as they move in the manner to be described herein. Alternatively, boom tube 101 may be straight along its entire length.

It has been found by experimentation that a depth of curvature of the curved boom 100 of about 152 mm, for a sail of maximum length along the plane of the boom of about 260 cm, is preferred, the depth being measured from the chord of the boom curvature to the centerline of boom tube 101. This curvature permits the sail to be set fairly flat, for high wind conditions, and still permits boom 100 to be rotated without interference from the tightened sail. The curvature also permits the desired small angle at the leading end of the boom, for operator comfort.

FIG. 2 is a fragmentary sectional view of camber control 110. Camber control 110 comprises a jackscrew 111 bored axially by hole 112 into which a sleeve **112*a* is pressed, and having a stop pin 113 inserted transversely, a nut 114 pressed into the forward end 102 of boom tube 101, a grip tube 116 pressed onto jackscrew 111 at their forward ends, a bushing 117 pressed into the aft end of grip tube 116, a wiping ring 118, and a cover 119**.

Jackscrew 111 is preferably fabricated from plastic having good resistance to salt water and sunlight, a low coefficient of friction, and reasonable dimensional stability. It is threaded with coarse threads of any form (Acme being illustrated) having about four (or, preferably, two) turns per linear inch (25.4 mm) of travel, for rapid adjustment, yet a good mechanical advantage. Four threads per inch will easily yield a theoretical mechanical advantage of over 17:1. Even should friction halve that value, it will be far greater than that now obtainable in conventional outhauls. Sleeve **112*a* is bored to provide a close fit on forward pivot pin 126 (to be discussed later). Sleeve 112*a* extends only partway of the length of hole 112, and is made of hard, corrosion resistant metal, such as one of the 300 series stainless steels into which grains of sand will not embed. Hole 112 is bored to a greater depth than is reached by the end of pivot pin 126, when the latter is inserted. This axial clearance, together with the radial clearance between pivot pin 126 and the walls of hole 112, act as a reservoir for grains of sand which may be present when pivot pin 126 is inserted into hole 112** during assembly. Thus, bearing seizure is prevented. Such grains of sand can be shaken out, or blown out, after subsequent disassembly.

Metal nut 114 is pressed into the forward boom tube end 102, although other means of securing it may be employed. Its threads provide a good clearance for those of jackscrew 111, to reduce friction and costs, and to permit for the possible incursion of very fine particles of grit without seizing. Grip tube 116 is pressed on jackscrew 111, and serves as a handle by which the operator rotates jackscrew 111. Its after end is supported by plastic bushing 117, which may be pressed into grip tube 116, or secured by adhesives. Bushing 117 may be omitted if the outer diameter of boom tube 101 is a close loose fit into grip tube 116; its major purpose is to provide support to grip tube 116 under the strain of the suspended weight of the sailor when leaning far out in high winds. Sand and grit are excluded by the wiping action of ring 118, which may be a ring of waxed flax, felt, oakum, rubber, or other of the well known gland packing materials.

Cover 119 is formed of heat-shrunk plastic tubing which fits intimately around the outer surfaces of grip tube 116, bushing 117, and wiping ring 118, retaining these in abutting relationship against the relative motion of the boom tube end 102, while tightly compressing ring 118 against the boom tube end 102 so as to wipe the latter clean of all sand and grit and the like. Cover 119 is preferably fabricated from expanded irradiated cross-linked polyolefin plastic, or any other common semi-rigid, or rigid, heat-shrink tubing, well known in the electronic cable art. Pin 113 may be used to prevent inadvertently turning the camber control assembly completely off the boom.

Figure 4:
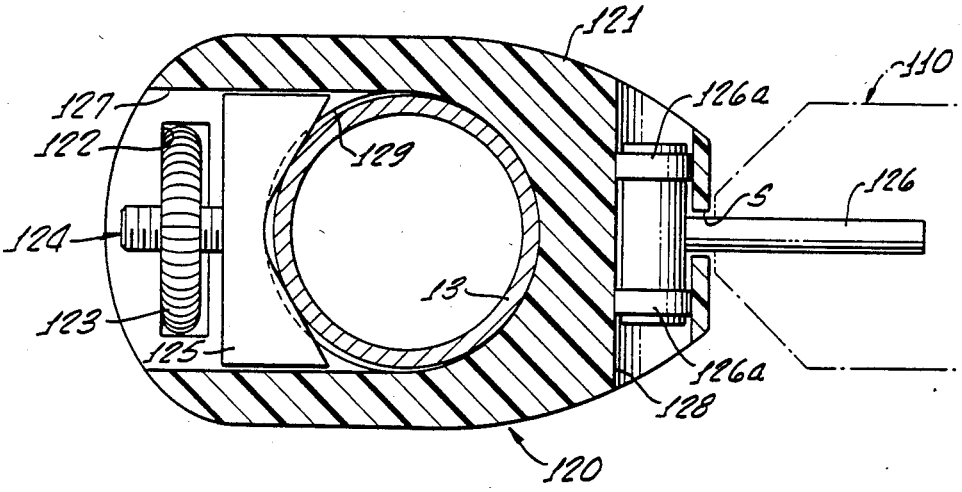
FIG. 4 is a fragmentary section view of the connection of the boom to the mast, looking downwards.

FIG. 3 illustrates the forward boom bearing and mast connection assembly 120, as seen from the side. FIG. 3 also indicates the relative placement of a D-ring 31. FIG. 4 is a horizontal sectional view taken as indicated in FIG. 3; showing the internal components of the forward boom bearing and mast connection assembly 120. (For clarity, D-ring 31 is omitted.)

Mast 13 is passed through a central opening 129 in a mast clamp body 121. (Opening 129 is large enough to pass the largest size of mast anticipated in use.) A thumbwheel (handwheel) 123 is threaded on a tang 124 of slide 125; rotation of thumbwheel 123 moves slide 125 in and out so as to clamp and release a range of masts of various sizes. Slide 125 moves within a mortise 127 which is formed in body 121 and intersects opening 129. Thumbwheel 123 is held in place by the walls of a slot 122 in body 121.

To assemble the mast clamping assembly into mast clamp body 121, slide 125 is first inserted into mortise 127 and pushed inwards so that tang 124 clears slot 122. Thumbwheel 123 is then dropped into place through slot 122 and held there while slide 125 is moved back until the threads on tang 124 engage those in thumbwheel 123. Thumbwheel 123 is then turned to retract slide 125 until the desired opening clearance is obtained for mast 13 to pass through. As can be seen in FIG. 3, thumbwheel 123 projects out of slot 122 so that it may be turned by the fingers and thumb of the operator, no tools being required.

D-ring 31, shown in FIG. 3, secures sail components 18 and 19 together, by being hooked through grommets 32 and 33 set in the forward edges of the mast sleeves of upper sail component 18 and lower sail component 19. D-ring 31 is preferably made from stainless steel rod, bent to shape, strong enough to resist the downhaul force in the sail without opening. The two ends of D-ring 31, which are hooked through grommets 32 and 33 next to mast 13, are preferably round in cross-section, so that D-ring 31 may be easily rotated aside (out of the plane of FIG. 3) to allow for easier access to thumbwheel 123.

This (the construction of FIGS. 3 and 4) is the preferred embodiment of the mast attachment and sail luff joining systems; being inexpensive, not requiring the use of tools in operation, allowing free rotation of the sail around mast 13 in the region of mast clamp assembly 120, permitting the sails to be close to each other, and being attractive in appearance. It is emphasized that the providing of the clamping mechanism on the forward side of the mast permits the forward boom end to be close to the mast, as is greatly desired. As the sail changes sides with the boom, when tacking or gybing, the allowing of free relative motion of the sail with respect to the boom and mast connection permits a better, unconstrained shape of the sail in the region of the boom.

Referring now to the after end of mast clamp body 121, a trunnion-like forward boom pivot 126 can be seen; set into loose bearing rings **126*a*, which are pressed into bore 128. Pivot 126 is preferably made of stainless steel, and may be forged in one piece; joined by welding, or by threading and staking. As can be seen best in FIG. 3, pivot 126 is free to rotate through large angles in the vertical, with its cylindrical shank projecting through a slot S that intercepts bore 128** transversely.

When the sailor furls the sail around mast 13, with the mast connection assembly left in place, he may turn pivot pin 126 until it is parallel with mast 13, whereupon it will not pierce nor strain the sailcloth as it is rolled around mast 13.

In use, boom 100 is slipped on the cylindrical shank of pivot 126, such that the shank passes through sleeve **112*a* (FIG. 2) and projects into hole 112. The forward end of jackscrew 110 rests against the cylindrical rear surface of mast clamp body 121, which serves as a thrust bearing. As shown in FIG. 3, the after end of mast clamp body 121 is cylindrical about a horizontal axis, as shown as 121*a***.

As the boom is rotated, sleeve **112*a* rotates around the shank of pivot 126, and the end of boom 100** moves around the cylindrical surface, as the forward end of the boom describes its conical path centered on the boom chord. The mast clamp and mast also rotate through the same angle in the horizontal, being clamped together, no other accommodation being necessary.

Loose bearing rings **126*a* have a clearance over the trunnion surface of the head of pivot pin 126 that is a significant portion of the axial lengths of rings 126*a***; a value of about one-third was found to be very successful during testing. Thus, the short, sloppy, loose bearings formed cannot contain a large buildup of sand, and the large relative motion permitted will shake out any sand during transport and use.

As previously indicated, the angle which the boom has, at regions near the mast, is very important to the comfort of the sailor. "Comfort" is no small matter in sailboarding, and its absence can involve actual pain. The angle of the boom portions near the mast is very important for another reason, namely, making it possible for the boom to rotate between the through upper and lower sail components 18 and 19 the edges of which are spaced apart only a short distance (at the mast) for minimized leakage of air.

Applicant's boom, at its forward end, has an angle less than about 30 degrees, and preferably less than about 15 degrees, both such angles being in relation to a line of reference (chord) that extends through the ends of the boom.

Furthermore, applicant's boom is preferably not reverse-bent (goosenecked) adjacent the mast, instead extending directly toward the axis of the mast as shown in FIGS. 1 and 4.

Applicant's boom-mast connector (besides having the important advantages and functions stated elsewhere in this specification) has a subtle motion when the boom rotates about its chord during tacking and gybing. No goose neck is desired, nor is the right-angle relationship of German Utility Model No. 7421380 desired, it being instead wanted that the forward boom end approach the mast at an acute angle. Furthermore, it is necessary for outhaul (camber) adjustment while under way (by the jackscrew) that grip tube 116 (FIG. 2) be rotatable about its own axis without interference from the mast or mast connector, and without affecting outhaul tension (such as is created by the elements of FIG. 6).

Referring to FIGS. 1, 4 and 5, it is emphasized that the forward end of the boom (namely, camber control 110 in the preferred form illustrated) pivots up and down as the boom roates about its chord during tacking or gybing. (Pivoting is preferably at the trunnion, but there could be—for example—a flexible spring or flexible plastic element instead.) At the same time, mast 13 rotates about its axis (it being pointed out that the masts of substantially all commercial sailboards can rotate about their axes, reference being made, for example, to FIG. 2 of U.S. Pat. No. Re. 31,167 and the accompanying disclosure, all of which are incorporated by reference herein).

Thus, the forward boom end describes a cone relative to the mast, as the boom rotates about its chord, but in space (not relative to the mast) a more complex path is described because of the pivoting of the mast about its axis.

All the while, the forward boom end bears on cylindrical surface 121*a* (FIG. 3) which is a thrust bearing surface, and there is boom rotation about element 126. All factors combine to achieve simplicity, smoothness, sand resistance, ability to adjust camber while underway, ability to pivot through adjacent lapped sails, and marked comfort for the sailor.

FIG. 5 is a fragmentary section view through the aft end 103 of boom tube 101, showing the twist-lock eccentric mechanism and boom extension tube 131. As discussed above, a like wiping ring 132 is provided to seal against sand and grit, and a similar bushing 133 is provided (if needed), and a seal cover 139 is also provided, made of heat-shrink tubing as before. Free eccentric cylinder 135 and bound eccentric cylinder 134 are turned to the same diameter, which is slightly smaller than the inside diameter of boom tube end 103, so that both may slide freely longitudinally when not locked. Preferably, these are made from materials which will not gall when in firm contact with boom tube 101. Such plastics as Delrin are suitable, having good shape stability and a reasonable coefficient of friction against dry aluminum.

Boom extension tube 131 is pressed tightly onto the reduced diameter of bound eccentric 134, such that they will always rotate and slide as one integral unit, even though made from different materials. Here again, adhesive or other fastening techniques may be employed. To reduce weight, bound eccentric 134 may be bored out at its press-fit end. Dashed line 138 indicates the longitudinal axis of the assembly and tubes 103 and 131. Centerline 137 indicates the eccentric axis along which both eccentrics 135 and 134 are drilled and tapped. Screw 136 is run through the off-center hole of eccentric 135 and staked in place in eccentric 134, leaving axial clearance to permit free relative rotation. If the diametral clearance between eccentrics 134 and 135, and the inside of boom tube end 103 is the common value of 0.229 mm (as employed in extruded telescoping aluminum tubes), then the offset between centerlines 137 and 138 should be at least twice that amount, to allow for manufacturing tolerances and to permit locking. If the eccentricity is made too large, however, then too small a twist will lock the assembly.

Figure 6:
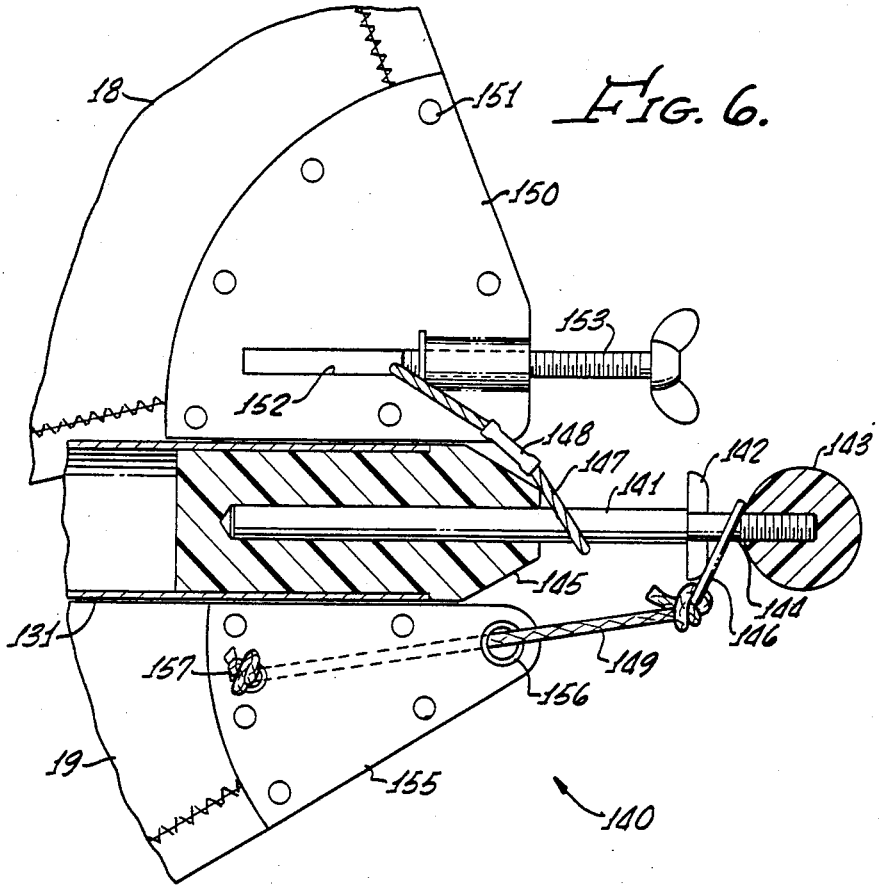
FIG. 6 is a fragmentary section of the aft end of the boom extension tube, showing the aft pivot pin and the clew connections, with the length adjustment and differential stretch compensating line.

FIG. 6 illustrates the aft boom bearing and sail connection assembly. End plug 145, which is of the same material as jackscrew 111 and bored longitudinally to fit aft pivot pin 141, is pressed into the aft end of boom extension tube 131. Aft pivot pin 141 is in intimate contact along its length with the bore of plug 145, yet can act as a back-up bearing. Such pin 141 may be hand-pushed into the associated bore during assembly.

Washer 142 is free to rotate on reduced diameter journal 144 of pin 141, as is ring 146. However, washer 142 could be made integrally with pivot pin 141.

Cable 147 (preferably formed of metal) is formed into a double loop, its ends secured by crimp means 148, and connects pivot pin 141 to the clew of upper sail component 18. The lower loop in cable 147 passes loosely around pivot pin 141, being retained axially by the end surface of end plug 145.

The clew of lower sail component 19 is connected to ring 146 by line 149; ring 146 is retained in place axially by washer 142, which abuts against the shoulder between journal 144 and the surface of 141. Ball 143 is screwed onto the threaded aft end of journal 144. It prevents loss of ring 146, and prevents puncture injury to anyone falling against the end of the boom assembly.

Ring 146 on journal 144, and the lower loop of cable 147 on pivot pin surface 141, act as the bearing assembly for the aft of boom 100. Both the ring 146 and cable 147 have cross-sectional shapes that are circular. Thus, their contact with the cylindrical journal surfaces of 144 and 141, respectively, are line contacts at most. Thus, little or no sand can be entrapped by them. What sand may adhere through stickiness will be easily shaken loose during any motion, and washed away by immersion in water. In addition, both ring 146 and the loop of cable 147 can be displaced axially, to pass around any obstructions, in the unlikely possibility such would be retained.

The small pin diameter, and the freedom of cable 147 and line 149 to ignore bending moments, insure that the geometric distortions of sail pull, as the boom follows its conical path, are small and insignificant.

It is emphasized that the "cable" 147 (preferably formed of metal) is not resilient or stretchable. Line 149, on the other hand, has a certain amount of stretch capability (being, for example, nylon).

In operation, pivot pin 141, with attached washer 142, ball 143, and ring 146, are secured to lower sail component 19 by line 149, thus preventing loss of parts in beach sand. The lower loop of cable 147 (which remains with upper sail component 18) is placed over the end of pivot pin 141, which end is then inserted into the bore in end plug 145, and then pivot pin 141 is pushed all the way and seated, by pushing on ball 143. To disassemble, pivot pin 141 is pulled free of end plug 145, whereupon cable 147 is free, and both sail components are disconnected from the boom.

OPERATION OF THE PREFERRED EMBODIMENT OF THE BOOM

When assembling, the two sail components and the mast mount are secured in place on the mast. The boom extension tube and the boom are grasped, one hand on each, and given a twist to unlock the extension, whereupon the extension is pushed in to reduce the length of the boom assembly to the minimum. Next, the end of forward pivot pin 126 is inserted into hole 112 (and bushing 112*a*) and seated. The lower loop of cable 147 is placed around the end of aft pivot pin 141, then the end of aft pivot pin is inserted into the bore in end plug 145 and seated. This completes assembly.

To use, the extension tube is pulled out of the boom tube until the sail attains a reasonable camber. Since this has no mechanical advantage, not everyone will be able to completely outhaul the sail to a small camber, but most can approach the desired camber. Then a twist is given to lock the extension in place. Next the camber control is rotated with respect to the boom, until the desired sail curvature is attained. If the sail has too large a camber, the camber control is rotated so as to lengthen the boom. For a right-hand screw thread the camber control is rotated counterclockwise, when looking at the fore end of the boom. The reverse of the above holds true.

Once the initial camber adjustment has been made, the sailor begins sailing, tacking and gybing and maneuvering as described in U.S. Pat. No. 4,365,570. When the wind changes, the sailor rotates the camber control in the proper direction with his forward hand. In high winds, when he must suspend a substantial portion of his body weight from the boom, it would be advantageous to use a boardsailor's harness, which can free his hand for this adjustment, by placing much of his body weight on the harness.

When through sailing, the sailor shortens the boom by untwisting the extension and moving it into the boom tube. He then pulls aft pivot pin 141 out of end plug 145, which disconnects the clews from the boom. Next he pulls the boom off the mast connection by pulling fore pivot pin 126 out of hole 112. He may then roll the sails around the mast, leaving the mast mount in place with pivot pin 126 pivoted out of the way.

Or, he may dismount the boom and both sail components and mast mount from the mast. The boom is stored in short (fully telescoped) condition, so it is small and may fit—with the sails—in a relatively short sail bag.

DETAILED DESCRIPTION OF THE VARIATION OF THE BOOM OF FIG. 7

Figure 7:
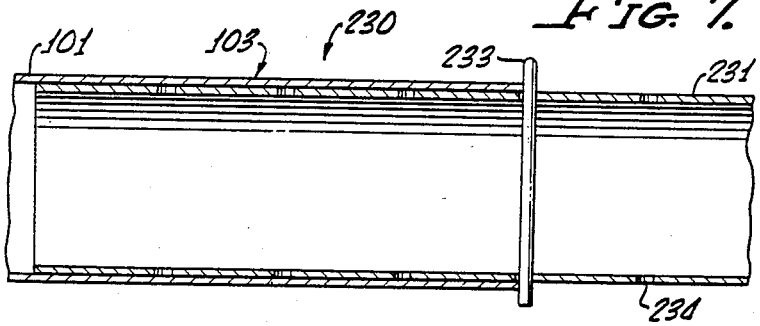
FIG. 7 is a side view of the second embodiment of the boom extension tube.

As shown in FIG. 7, a modified boom extension tube 231, having a plurality of diametrically-opposed pairs of holes 234, is inserted into the boom tube end 103. Such tube 231, hole, etc., construction is the presently-preferred form. Retaining clip 233 is inserted through a pair of holes 234, to set the desired length of outward projection of boom extension tube 231. The inward tension exerted by the sail on the end of boom extension 231 holds retaining clip 233 against the end of boom tube 101. Retaining clip 233 is held on place in holes 234 by its external hairpin-shaped leg, which grips the outside of boom extension 231 by spring action. Retaining clip 233 may be tied to boom extension 231 by a long lanyard (not shown), to prevent loss. Other types of pins or clips may be substituted for retaining clip 233, such as the common "Quick-pin" used in shackles on yachts.

Boom extension 231 may be filled with foam, to provide flotation (as may the interior of boom tube 101); after which holes 234 are drilled. The aft end of boom extension 231 is provided with the identical end plug 145, as was provided for boom extension 131; in all other respects, aside from fixing extended lengths, the two extensions perform the identical functions. Note that boom extension 231 does not require that sand be prevented from entering the interior, having no close-fitting working parts, therefore no wiping ring, bushing or heat-shrink cover need be provided. Thus, this variation offers a lower manufacturing cost to the user, although perhaps not as convenient in operation. When changing sails, or upon assembly, retaining clip 233 is moved to the proper new pair of holes 234, a simple procedure. However, during disassembly, the sailor may have to relieve the sail tension in order to extract retaining clip 233, by turning in camber control 110 so as to shorten the overall boom length, unless he is fairly strong. The location of pairs of holes 234 may be at regular intervals smaller than the total range of camber control 110, or may be clustered in groups around the nominal lengths of various sails—to provide for manufacturing tolerances in sailmaking and for permanent stretch. As new sails appear, it would be simple for the user, or the dealer, to drill new pairs of holes as needed, taking care only not to greatly weaken the boom extension tube.

When it is certain that a customer will not wish to use sails of differing lengths, boom tube 101 may be fabricated to full length and boom extensions omitted entirely, for the lowest possible cost of manufacture. In this case, end plug 145 must be made in a larger diameter, and pressed into the extended end of boom tube 101. Camber control 110 should then have a large enough range of adjustment to take care of permanent stretch and sailmaking tolerances, or other means for this should be provided on the sail components, as will be disclosed later herein.

DETAILED DESCRIPTION OF LENGTH AND COMPENSATION ADJUSTERS

Referring again to FIG. 6, the sail length adjusting and stretch compensating apparatus is seen. Clew plate 150 is fastened to the clew of upper sail component 18 by a plurality of rivets 151, it being understood that clew plate 150 comprises two identical thin aluminum plates, one to each side of the fabric clamped therebetween. Slot 152 pierces completely through both aluminum plates and the fabric of the sail, and the upper loop of cable 147 is formed through slot 152. The sail tension of 18 pulls against the upper loop of cable 147 such that it remains against the rear end of slot 152, unless wingscrew 153 is turned so it moves into and along slot 152. Immediately aft of slot 152 the thin plates of clew plate 150 are bent into opposing arches and threaded, to receive wingscrew 153. Turning wingscrew 153 such that it projects further into slot 152 has the effect that upper sail component 18 is stretched laterally aftwards. Thus, any mismatch in relative lengths of the sail components may be adjusted out, including mismatches caused by manufacturing tolerances, and permanent deformations from use.

Clew plate 155, similarly made of a pair of thin aluminum plates on both sides of the sail fabric, riveted together by rivets 151, is attached to the clew corner of lower sail component 19. Nylon line 149 is passed through hole 157 and then back through larger hole 156, then tied off to ring 146, as shown. Hole 156 is chamfered and deburred, to offer the minimum friction to line 149, while supporting the end of clew plate 155. The length, diameter, and stretch coefficient of elastic line 149 are chosen so as to generate enough stretch to match the greater stretch of upper sail component 18 (the upper-sail stretch being greater because of the larger area of the upper sail) along the plane of boom 100. The use of both holes 156 and 157 allows for a longer length of line 149 than would be possible if line 149 were terminated at hole 156, in the usual manner. Differential stretch compensator line 149 can be replaced by the proper size of bungee cord, springs or other elastic elements.

SIMPLIFIED LENGTH AND COMPENSATION ADJUSTMENT

In certain cases the sail connection assembly, and the length and compensation assemblies, may be simplified. This requires the upper sail component to be made with a minimum of stretch, as by using mylar film/terylene composite sails, or by cutting and sewing the upper sail component such that at least some threads run generally parallel with the head of the lower sail component. This latter may be done by using a radial, or "spiderweb" cut, with seams radiating from the clew corner, or by a variation of the tri-radial cut used on spinnakers, having seams radiating from each corner and intersecting at the center. The stretch parallel to head 22 of such a sail will be greatly reduced over that from a sail with threads parallel to the leach chord only.

In the simplified construction, clew plates 150 and 155 are omitted, as are elements 152 and 153. Cable 147 (or a suitable ring shackle, or carabiner, substituted therefor) connects to a grommet in the upper sail.

All adjustment is effected by line 149, which connects to a grommet in the lower sail. To ensure adequate length of such line 149, the length of head 22 (of sail 19) is reduced slightly in length. This ensures that head 22 is always shorter than the equivalent length of upper sail component 18, during manufacture, use, and under stretch. To match the lengths of both sails, line 149 is tied longer or shorter, as the case may be.

Because head 22 is made short enough to permit an adequate length of line 149 for what little stretch compensation is required, washer 142 may also be eliminated, whereupon ring 146 will bear directly upon the end of end plug 145, with the lower loop of cable 147 passing through ring 146, ring 146 being larger.

Figure 9:
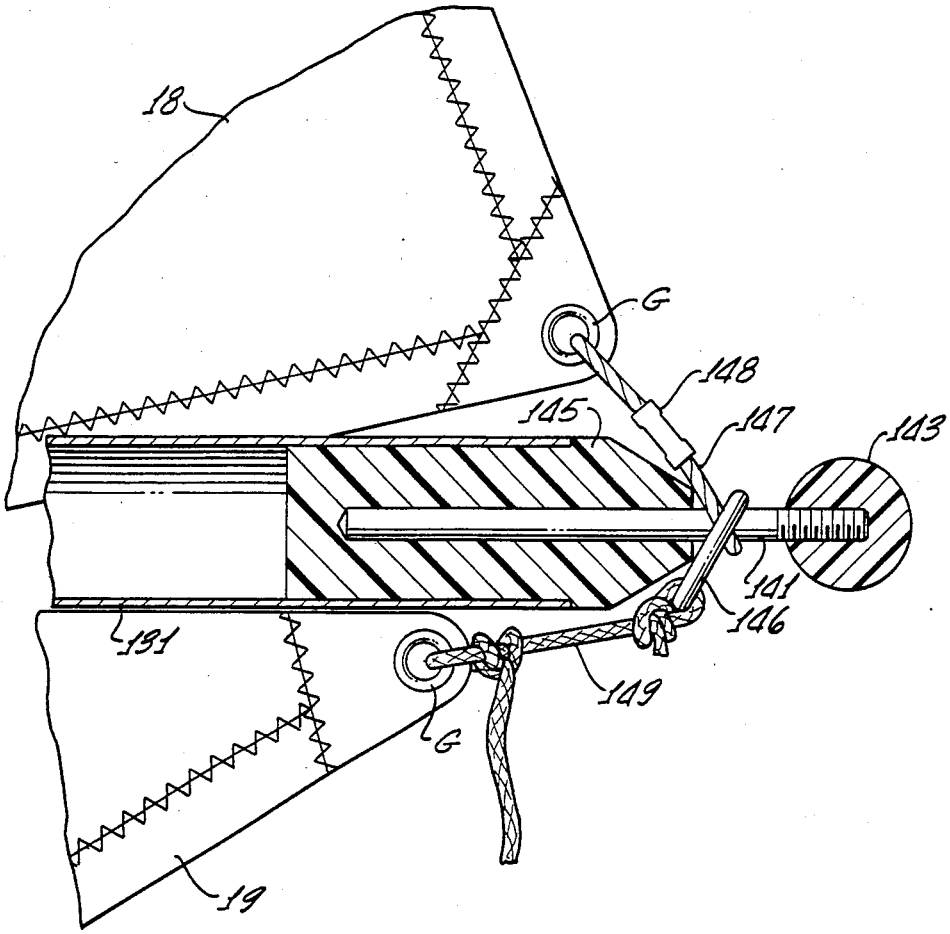
FIG. 9 shows a simplified form of rear bearing and adjustment means.

FIG. 9 shows the simplified form just described. Each single grommet is shown at G.

ALTERNATIVE FORM OF MAST CONNECTOR AND BEARING

The single D-ring 31 (FIG. 3) may, if desired, be replaced by port and starboard (separate) D-rings located well away from thumbwheel 123, for greater strength and convenience.

There will now be described, with reference to FIG. 8, and for the purpose of ensuring continuity of patent applications, the no longer-preferred mast connector that was shown in FIG. 3 of U.S. application Ser. No. 06/371,226.

Trunion tube 324 (FIG. 8) is preferably made of metal with a hard surface and good corrosion resistance, such as one of the 300 series stainless steels. It permits upward and downward rotation of the boom, whose forward end also describes a conical path, and also allows for different angles between mast and boom in the vertical, as when the mast bends in high winds, changing sails, etc. Holes 325, in the parallel ears of mast mount 321, have a large clearance over trunnion tube 324, far greater than is standard machine-shop practice. With an ear thickness of 4.8 mm, and a trunnion diameter of 25.4 mm, the clearance would be about 1.6 mm, or about one-third of the bearing length. This short, sloppy bearing is not able to contain a large buildup of sand, and the large relative motion would push out any sand during transport and sailing. In addition, water can easily rush through the hollow trunnion tube and the bearing holes 325, to wash out any sand grains adhering from sticky residues, when the rig is laid on the water, preparatory to sailing. Similarly, reduced diameter journal 327 of forward pivot pin 126 is fit through sloppy holes 328 in the thin walls of trunnion tube 324. Head 329 retains pivot pin 126 in place, to prevent loss in beach sand, and is formed after insertion, by cold-heading or hot forging. Journal 327 is the primary rotary bearing for the forward end of boom 100, backed up by the ability of pivot pin 126 to rotate in hole 112 (which does not, in this embodiment, have bushing **112*a*) of jackscrew 111. As indicated by dashed lines at 110, in FIG. 8, boom 100 is pushed into place on pin 126, and pulled off for easy tool-less disassembly and assembly. The tapered forward end of jackscrew 111 can be used to keep trunnion tube 324 centered between the ears of mast mount 321; however, this can also be done by the proper sizing of head 329, length of trunnion tube 324**, and the spacing between the ears.

ADDITIONAL DISCUSSION OF BEARING AND SAIL-ADJUSTMENT MEANS

It is of distinct importance to the present boom that elements 126, 141, and 144 are small in diameter, which means small in diameter in comparison to boom diameter. Each such element is only a small fraction of boom diameter, thus minimizing friction and sand clogging and achieving other benefits.

Applicant has discovered that a large diameter at the aft bearing increases sail distortion during rotation of the curved boom about its chord. For example, if the aft bearing (as in FIG. 9) were large instead of small as it now is, one of the upper and lower sails would tension, and the other would relax, during boom rotation. (In other words, there would be distortions in outhaul adjustments.)

Thus, applicant's small diameter not only reduces friction and sand exposure, but minimizes sail distortions during boom rotation.

The foregoing description is to be understood clearly as given by way of illustration and example only, the spirit and scope of this invention being limited solely by the appended claims:

What is claimed is:

1. A sail system for a sailing craft, for example a sailboard, of the type in which an operator rides in standing position, and manipulates the sail system in order to effect propulsion of the board, the sail system comprising a mast (13), sail means connected to the mast (13), the sail means including an upper sail component (18) and a lower sail component (19), a single boom (100) extending generally transversely away from the mast (13) to the vicinity of the clews (150,155) of the sail components (18,19), adapted to be held by the operator when sailing, having mast connecting means (120) and aft bearing and clew connecting means (140) adapted to permit free rotary motion between the boom (100) and the sail components (18,19), the aft bearing and clew connecting means including a loose-fitting, short-length bearing assembly comprising a pivot pin (141) mounted coaxially in the aft end of the boom (100) and extending through the substantially larger inner diameter of at least one clew connecting annulus (146,147), the annulus (146,147) being free to move a substantial distance both radially and axially so as to prevent the entrapping of sand and resulting seizure.

2. A sail system according to claim 1, wherein the mast connecting means (120) includes forward boom bearing means (**112*a*,126) coaxial with the boom (100), whereby, in combination with aft boom bearing means, the boom (100) may be rotated between the upper and lower sail components (18,19**) when tacking and gybing.

3. A sail system according to claim 2, wherein the boom (100) is curved for at least a portion of its length.

4. A sail system according to claim 3, wherein the diameter of the pivot pin (141) is small in comparison to that of the boom (100), whereby the geometric distortions of sail pull caused by rotation of the curved boom (100) are minimized.

5. A sail system according to claims 3 or 4, wherein the forward end of the boom (100) is set at a small angle to the chord of the boom, said small angle being less than about 30 degrees, and preferably less than about 15 degrees.

6. A sail system according to claim 3, wherein at least one bearing means includes a pivot pin (126 or 141) insertable by hand.

7. A sail system according to claim 6, wherein the pivot pin (126) is insertable by hand into a hole (**112,112*a*) in the fore end of the boom (100**).

8. A sail system according to claim 7, wherein the forward pivot pin (126) is provided with a trunnion-shaped head set at a right angle to the shank, the trunnion-shaped head being set in loose, short bearing rings (**126*a*) retained in a transverse bore (128) in the mast clamp body (121), thereby allowing free vertical rotation of the forward pivot pin (126**) and preventing the retention of sand therebetween and resulting seizure.

9. A sail system according to claim 7, wherein the forward pivot pin (126) is flexibly connected to the mast connecting means (120) such that the pivot pin (126) is permitted to rotate vertically.

10. A sail system according to claim 6, wherein the pivot pin (141) is insertable by hand into a hole in the aft of the boom (100).

11. A sail system according to claim 1, wherein the mast connecting means (120) includes mast clamp means comprising a mast clamp body (121) having a central opening (129) through which the mast (13) is passed, and a slide (125) which clamps the mast (13) against the walls of the central opening (129) when the slide (125) is moved inwards along a mortise (126) by rotation of a thumbwheel (123) contained in a slot (122) and turning on the threaded tang (124) of the slide (125); whereby the boom (100) is connected to the mast (13) without the use of tools.

12. A sail system according to claim 1, including means for changing the total length of the boom.

13. A sail system according to claim 12, wherein the means for changing the total length of the boom is located along the boom (100) within reach of the operator and operable by the operator while the sail means (18, 19) are filled with wind and drawing and while suspending a significant proportion of his weight from the boom (100).

14. A sail system according to claim 13, wherein the means for changing the total length of the boom is a camber control means (110) located in the forward portion of the boom within reach of the operator's forward hand, and by which the operator may cause the change in total length of the boom (100) to change the curvature of the sail means (18, 19) responsive to changes in the wind, while the sail means (18, 19) are filled and drawing, and while the operator is suspending a significant proportion of his weight from the boom (100).

15. A sail system according to claim 14, wherein the camber control means includes a jackscrew (115) and a mating nut (114).

16. A sail system according to claim 15, wherein the jackscrew (115) is connected to an external cylindrical grip tube (116) by which the jackscrew (115) may be rotated, and further wherein the nut (114) is fastened to the forward end (102) of the boom (100) whereby the nut (114) may be counterrotated.

17. A sail system according to claim 12, wherein the means for changing the total length of the boom includes boom extension means to change and fix the total length of the boom (100) when changing from sails of one length along the boom to another, the boom extension means being independent of any means to control sail means (18, 19) camber or shape.

18. A sail system according to claim 17, wherein the boom extension means (130) includes an extension tube (131) connected to eccentric locking means (134, 135) internal to the boom (100).

19. A sail system according to claim 17, wherein the boom extension means (230) includes an extension tube (231) having a plurality of holes (234) spaced at desired intervals along the length of the extension tube (231), and retaining means (233) insertable through any desired hole (234), whereby the extension tube (231) is retained in position by contact of the retaining means (233) with the aft end (103) of the boom, under the inward forces exerted by the sail means (18, 19).

20. A sail system according to claims 18 or 19, wherein the extension tube (131, 231) is filled with foam, to provide flotation.

21. A sail system according to claim 12, including wiping means to prevent the entry of sand, grit, and other particles into the interior of the boom (100) during operation of the means for changing the total length of the boom.

22. A sail system according to claim 21, wherein the wiping means includes a ring composed of compressible material (118, 132).

23. A sail system according to claim 22, including heat-shrinkable tubing (119, 139) in intimate contact with the outer periphery of the wiping ring (118, 132), whereby the wiping ring (118, 132) is retained in its intended relationship with the means for changing the total length of the boom (110, 130) during operation, and further whereby the wiping ring (118, 130) is compressed into intimate contact with the surface it wipes.

24. A sail system according to claim 1, wherein the boom (100) is filled with foam, to provide flotation.

25. A Sail system according to claim 1, including means to match the lengths along the boom (100) of the upper sail component (18) and the lower sail component (19), when the sail components (18, 19) are not being stretched by wind, whereby mismatches in manufacture and permanent deformations may be corrected.

26. A sail system according to claim 25, including means to compensate for the greater stretch along the boom (100) caused by wind loading of a larger sail component (18) compared to the stretch of a smaller sail component (19).

27. A sail system according to claim 26 wherein the means to compensate for mismatches during manufacture and permanent deformations includes a wingscrew (153) acting upon a clew connecting means (148).

28. A sail system according to claim 27, wherein the larger sail component (18) is made of a film-and-cloth composite material, whereby its tendency to stretch is reduced.

29. A sail system according to claim 26, wherein the means to compensate for stretch caused by wind loading include a resilient stretchable member (149) connected between the aft end of the boom (100) and the clew (155) of the smaller sail component (19), and a non-stretchable member (147, 148) connected between the aft end of the boom (100) and the clew (150, G) of the larger sail component (18); whereby the tension induced by the wind in the smaller sail component (19) stretches the resilient stretchable member (149).

30. A sail system according to claim 29, wherein the larger sail component is cut and sewn with seams radiating from the clew corner (150, G) with threads laid parallel to the axis of rotation of the boom (100), whereby its tendency to stretch along the axis of rotation of the boom is reduced.

31. A sail system according to claim 1, wherein the upper sail component (18) is secured in fixed relationship to the lower sail component (19) by luff joining means (31) which are adapted to permit free rotation of the mast sleeves of the sail means (18, 19) around the mast (13) and the mast connecting means (120).

32. A sail system according to claim 31, wherein the luff joining means include at least one D-ring (31) capable of being rotated aside to permit access to a thumbwheel (123) in the mast connecting means (120).

33. A sail system according to claim 1, in which adjacent edge portions of the upper and lower sail components are lapped relative to each other.

34. A method for sailing a craft which includes a mast (13) pivotally mounted on the craft, upper and lower sail portions mounted on the mast and connected to a boom (100), a lower edge (21) of the upper sail portion (18) and an upper edge (22) of the lower sail portion (19) being lapped, the sail portions having mast sleeves at their luffs for connecting to the mast, and links (146, 147) connected to clew attachments (150, 155) at the clew corners of the sail portions, the boom having an aft pivot (141) for connecting to the links, and a forward bearing sleeve (112*a*) for connecting to the fore pivot (126) mounted in a mast clamp (120), the mast clamp having a thumbwheel (123) and a slide (125) for clamping to the mast, and a D-ring (31) for connecting the mast sleeves of the sail portions together by means of grommets (32, 33) set in adjacent locations in the mast sleeves; the method comprising connecting the upper and lower sail portions by hooking the D-ring (31) through the grommets (32, 33) in adjacent locations in the mast sleeves, inserting the mast (13) into the mast sleeves and the central opening (129) of the mast clamp (120), turning the thumbwheel (123) until the slide (125) bears against the mast (13), inserting the aft pivot (141) through the links (146, 147) and into the aft end of the boom (100), and sailing the craft with the lower edge (21) of the upper sail portion (18) lapped relative to the upper edge (22) of the lower sail portion (19).

35. The method of sailing according to claim 34, wherein at least one clew attachment (150) has an adjusting wingscrew (153), including the step of turning the wingscrew (153) to match the lengths along the boom of the upper and lower sail portions, thereby eliminating any mismatches in length incurred in manufacture or resulting from deformation from use.

36. The method of sailing according to claim 34, wherein at least one clew attachment (15) is connected to a link (146) by a line (149), including the step of tying the line (149) to the link (146) at the proper length to match the lengths along the boom of the upper and lower sail portions, thereby eliminating any mismatches in length incurred in manufacture or resulting from deformation from use.

37. The method of sailing according to claim 34, wherein the clew attachment (155) of the smaller sail portion (19) is connected to a link (146) by a resilient member (149), whereby the greater stretch along the boom of the larger sail portion (18) may be compensated.

38. The method of sailing according to claim 34, wherein the boom (100) has an internal jackscrew outhaul mechanism (110) located in the forward portion of the boom within reach of an operator's forward hand even when suspending a significant part of his weight from the boom; including the steps of adjusting the outhaul mechanism (110) to achieve a desired sail curvature, sailing on the port tack and readjusting the outhaul (110) with the left hand responsive to changes in wind speed, changing to the starboard tack and readjusting the outhaul (110) with the right hand responsive to any further changes in the wind speed.

* * * * *